United States Patent [19]

Pall

[11] 4,409,765

[45] Oct. 18, 1983

[54] EARTH-QUAKE PROOF BUILDING CONSTRUCTION

[76] Inventor: Avtar S. Pall, Centre for Building Studies, Concordia University, 1455 de Maisonneuve Blvd. W., Montreal, Que., Canada, H3G 1M8

[21] Appl. No.: 162,394

[22] Filed: Jun. 24, 1980

[51] Int. Cl.[3] ..... E02D 27/34

[52] U.S. Cl. ..... 52/167; 52/573

[58] Field of Search ..... 52/167, 573; 14/16.1; 188/251 M

[56] References Cited

U.S. PATENT DOCUMENTS

| | | | |
|---|---|---|---|
| 879,595 | 2/1908 | Smith | 52/167 |
| 2,408,430 | 10/1946 | Lowey et al. | 188/251 M |
| 2,464,437 | 3/1949 | Dasher | 188/251 M |
| 2,968,458 | 1/1961 | Moeller | 52/167 |
| 3,233,376 | 2/1966 | Naillon et al. | 52/167 X |
| 3,418,768 | 12/1968 | Cardan | 52/167 |
| 3,767,386 | 10/1973 | Ueda et al. | 188/251 M |
| 4,094,111 | 6/1978 | Creegan | 52/167 |

FOREIGN PATENT DOCUMENTS

| | | | |
|---|---|---|---|
| 52-12744 | 1/1977 | Japan | 52/167 |
| 52-19436 | 2/1977 | Japan | 52/167 |
| 53-19655 | 2/1978 | Japan | 52/167 |
| 1321837 | 7/1973 | United Kingdom | 52/167 |

*Primary Examiner*—Carl D. Friedman

*Attorney, Agent, or Firm*—Schwartz, Jeffery, Schwaab, Mack, Blumenthal & Koch

[57] ABSTRACT

A building has a pair of structural elements with a member connecting these structural elements; the member has a slip joint with surfaces exhibiting substantial frictional characteristics and stable hysteretic behavior. The slip joint includes clamping means forcing said surfaces together to define a slippage interface for relative motion between the surfaces upon the application of a force tending to induce such motion of a large magnitude typically experienced during an earthquake.

11 Claims, 10 Drawing Figures

EARTH-QUAKE PROOF BUILDING CONSTRUCTION

FIELD OF THE INVENTION

This invention relates to building construction and, in particular, providing structures designed to render a building less prone to damage by earthquakes.

PRIOR ART

Severe ground shaking induces lateral interial forces on buildings causing them to sway back and forth with an amplitude proportional to the energy fed into the buildings. If a major portion of this energy can be consumed during building motion, the seismic response can be considerably improved and the manner in which this energy is consumed in the structure determines the level of damage.

In general, all current methods of aseismic design place reliance on the ductility of the structural elements, i.e. ability to dissipate energy which is undergoing inelastic deformations. This assumes some permanent damage, in some cases just short of collapse, and repair costs can be high. If a major portion of the seismic energy can be dissipated mechanically, the response of the structure can be controlled without structural damage.

Braced structural steel frames are known to be economical and are effective in controlling lateral deflections due to wind and moderate earthquakes. However, during major earthquakes, these structures do not perform well, because, firstly being stiffer they tend to invite higher seismic forces and, secondly, their energy dissipation capacity is very limited due to the pinched hysteretic behaviour of the braces. Because energy dissipation is poor in structures with such pinched hysteresis loops, they have been viewed with suspicion for earthquake resistance.

The performance of such braced structures is still poor when the brace is designed to be effective only in tension. While a tension brace stretches during application of the load, on the next application of the shock load an elongated brace is not effective even in tension until it is taut again and is being stretched further. As a result energy dissipation degrades very quickly.

Moment resisting frames are favoured for their earthquake resistance capability because they have stable ductile behaviour under repeated reversing loads. Their preference is reflected in various seismic codes by assigning lower lateral forces. However, the structures are very flexible and it is often economically difficult to develop enough stiffness to control storey drifts and deflections to prevent non-structural damage.

Recent earthquakes have demonstrated the need for stiffer structures and a strong interest has grown in the past few years to develop structural systems which combine the excellent ductile behaviour of the moment resisting frame and the stiffness of a braced frame. In Japan, designers often employ braced moment resisting frames in which the brace is designed to carry only a portion of the lateral load. The eccentric braced frame is another step in the direction. In this method, the brace joints are eccentric to force the beams into inelastic action to dissipate energy, the energy sacrificing the main beams to save the structure from total collapse. Logically, it would seem preferable for secondary members to yield first in order to protect the main members.

SUMMARY OF THE INVENTION

The present invention uses in a frame building, first and second spaced apart structural members with a third structural member connecting the first and second members to form a frame in the building. A diagonal brace connects the frame, the brace operating on a slip joint with surfaces exhibiting substantial frictional characteristics and stable hysteretic behaviour; the slip joint has clamping means forcing the frictional surfaces together to define a slipping interface for relative motion between the surfaces upon the application of sufficient force such as that experienced during an earthquake.

In a further embodiment a further brace is secured to the frame and in angular relationship to the brace already described; the further brace acts through the same slip joint.

In yet another embodiment, the angularly related braces each have an individual slip joint with the characteristics already described; a member rotatably mounted on the frame has opposed ends which engage the braces with the result that if one brace moves on tension along its slip joint, the other brace will be urged by the rotatable member to move in compression along its slip joint. It will be appreciated that pre-assembled in-filled panels or curtain walls may be used to function as diagonal braces, which are connected to the frame with a slip joint.

In a further embodiment the braces are crossed and connected by pivoted links intermediate of their length, with the individual slip joints located within the area bounded by the links; the clamping means may be common to both slip joints.

In a further embodiment of the invention and in a building having a foundation wall, a plinth beam is located above the foundation wall and spaced therefrom; a plate is secured to the underside of the plinth beam which plate is itself dished on the underside. A support member is provided for the dished plate and secured to the foundation wall; a frictional contact surface is provided between the dished plate and the support member, the latter being adapted to move laterally with any severe ground motion, such as that created by a major earthquake.

The slipping surfaces which are requisite for the invention may be provided in many ways, but practically and preferably, brake lining pads are used.

BRIEF DESCRIPTION OF THE DRAWINGS

The invention will now be described in relation to the accompanying drawings wherein.

DESCRIPTION OF THE INVENTION

Figure 5:
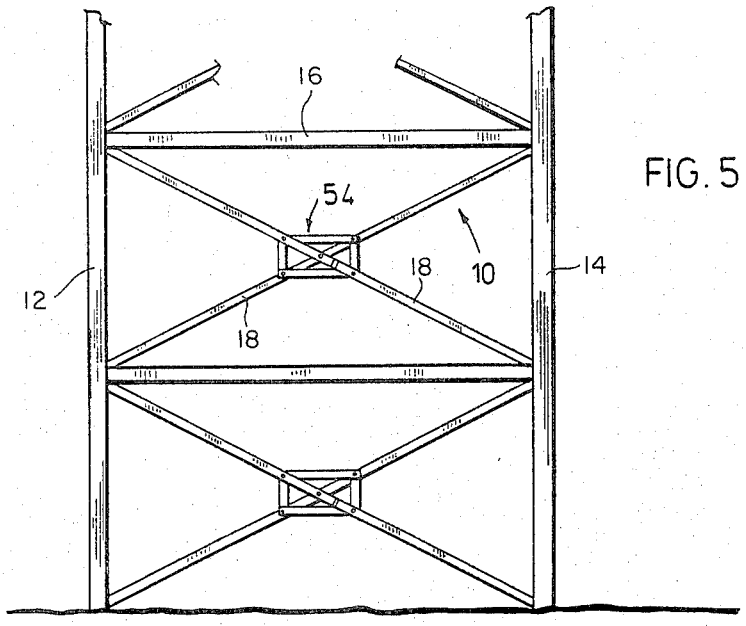
FIG. 5 is an elevation view of a further embodiment of the invention wherein a friction device is incorporated in the moment resisting frame.

FIG. 5 shows a frame generally denoted by the numeral 10 comprising a pair of spaced apart columns 12 and 14 connected together with a beam 16; it will be appreciated that this is the base frame structure of a building which will extend upwards in similar units. The columns 12, 14 and the beam 16 are, of course, made of a structural material, such as steel.

Figure 1:
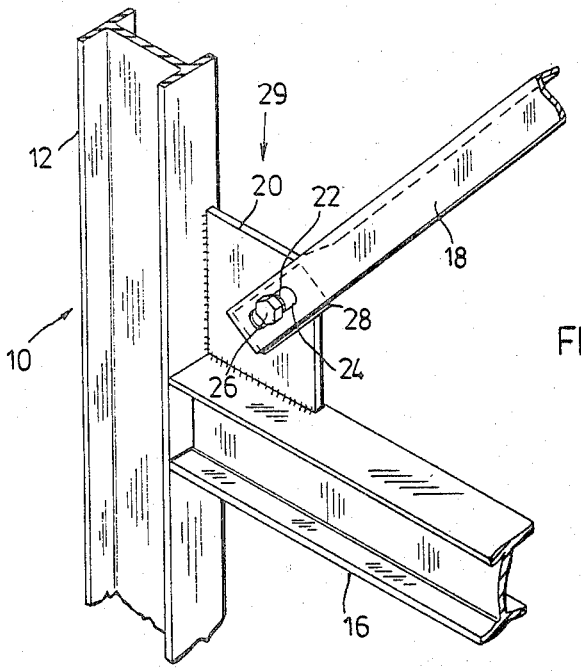
FIG. 1 is an elevation view of one embodiment of the invention showing a diagonally disposed brace in a frame to which it is connected by a slip joint.

The frame 10 contains a brace 18 which is diagonally disposed and conveniently connected to the frame 10 through a corner gusset 20 which has a hole 22 as shown in FIG. 1. The brace 18 has a slotted hole 24 and is secured to the gusset 20 by means of a bolt and nut 26 which traverses the holes 22 and 24. Interposted between the brace 18 and the gusset 20 is a brake lining pad 28, which provides frictional resistance to movement of the brace 18 in relation to the frame 10 when the latter is displaced during an earthquake.

It will be appreciated that the brake lining pad 28 may be eliminated if one or both of the adjacent surfaces of the brace 18 and gusset 20 are provided with surfaces roughened to the requisite degree by known expedients.

The connection between the brace 18 and the gusset 20 forms along the slot 22 a frictional slip joint, generally denoted by the numeral 29, in which the friction can be adjusted through the bolt nut 26. The slip joint 29 will slip at a predetermined load and dissipate a substantial amount of energy in each cycle. The result is that rupture of the frame 10 is prevented at least until movement along the slot 26 is completed; within this limit, the unbroken frame, due to its resiliance, will return to its normal position.

Figure 2:
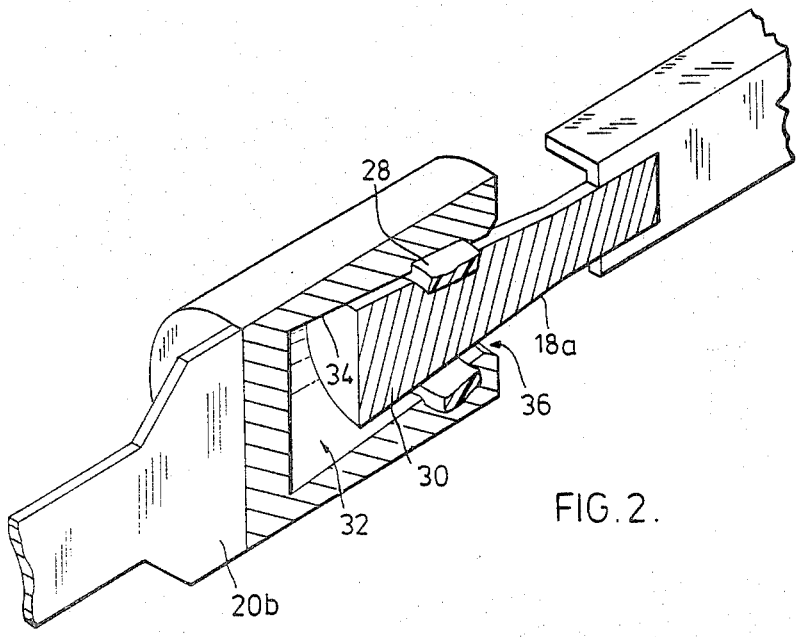
FIG. 2 is an elevation view of a further embodiment of the invention shown in FIG. 1 wherein the slip joint is formed of a tapered cylinder with a slipping piston therein, separated by friction pads.

In the embodiment shown in FIG. 2, a brace **18*a* has one end formed into a piston 30 which is located in a gusset 20*b* which has a cavity 32 with an inner wall 34 tapering towards the entrace 36 of the gusset 20*b*. The diameter of the piston 30 increases towards its free end and interposed between the wall 34 and the piston 30 are brake lining pads 28. This sloping arrangement enables the brace 18*a* to slip at a lower load in compression than in tension, thus mitigating buckling of the brace 18*a*** in compression. It will be appreciated by applying the clamping force at an angle to the movement the above behaviour in tension and compression is achieved.

Figure 3:
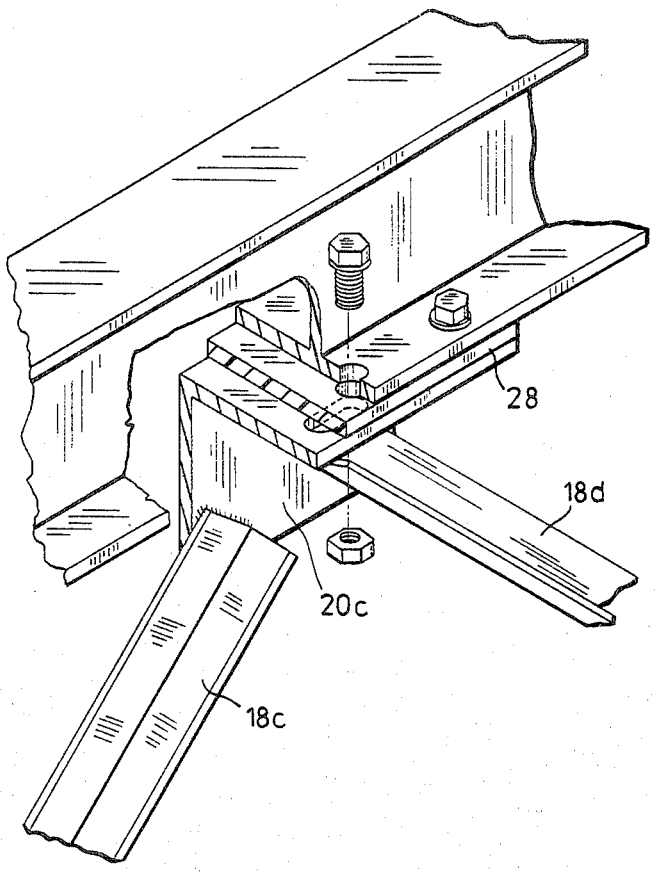
FIG. 3 is an elevation view of a further embodiment of the invention wherein a further brace is incorporated in the frame in angular relationship and connected to a common slip joint on the frame.

In FIG. 3 the embodiment shows a pair of diagonally opposed braces **18*c* and 18*d* secured to a gusset 20*c* which is slidably mounted on the cross beam 16 to form a slip joint 29 of a type already described. The gusset 20*c* is shown as secured to the cross beam 16 but it will be appreciated that the gusset 20*c* could be equally well attached to column 12 or 14**.

Figure 4:
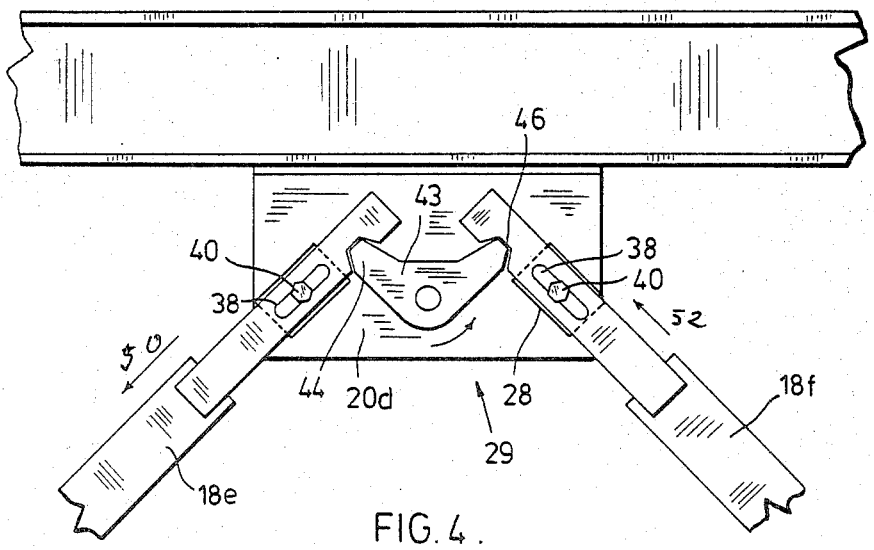
FIG. 4 is an elevation view of a further embodiment of the invention wherein the angularly related braces shown in FIG. 3, each have an individual slip joint and a rotatable member acts on both braces.

In the embodiment shown in FIG. 4 the gusset **20*d* is welded to the cross beam 16 and to provide the slip joint 29, the braces 18*e* and 18*f* are slotted as at 38 and secured to the gusset 20*d* by means of adjustable bolts 40 which are carried by the gusset 20*d*. Brake pads 28 are interposed between the gusset 20*d* and the braces 18*e* and 18*f*. A member 43 is rotatably mounted on the gusset 20*d*; the member 43 has opposed ends 44, each of which engage in slots 46 in the braces 18*e* and 18*f* as shown. It will be understood that in the event of a tension being exerted on brace 18*e*, the latter will slip along its slip joint 29, but the member 43 will move with the brace 18*e* and exert a force on brace 18*f* to move it even though it is under low compression and due to buckled condition, the movement respectively being indicated by arrows 50 and 52**.

A particularly useful embodiment of the invention is located in the frame 10 as shown diagrammatically in FIG. 5. This embodiment is illustrated in detail in FIG. 6 and it shows a pair of diagonally disposed cross braces **18*h* and 18*i* with their ends secured to the frame 10. Each brace 18*h* and 18*i* has an individual slip joint 29*h* and 29*i* of the type already described. Intermediate of the securement of the braces 18*h* and 18*i* and the location of the slip joints 29*h* and 29*i*, is a linkage, generally denoted by the numeral 54, which comprises four links 56 forming a substantially rectangular frame, and pivotally secured at its corners to the cross braces 18*h* and 18*i*; the latter are spaced apart by a spacer 58 which is preferably positioned at the centre and over the slots traversed by the tightening bolt 60**.

Figure 6:
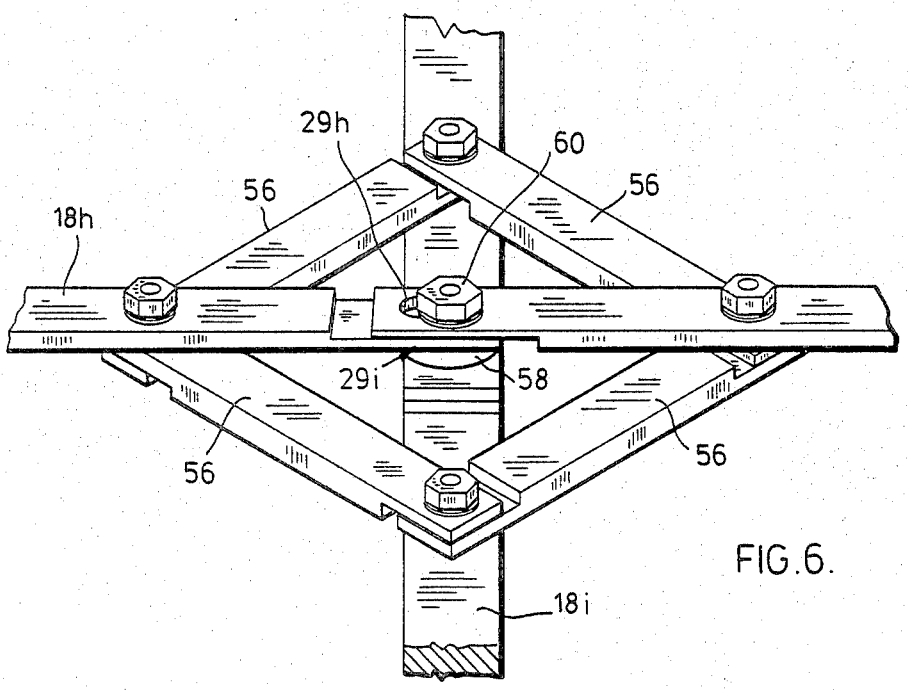
FIG. 6 is a perspective view, on an enlarged scale, of the friction device shown in FIG. 5.
Figure 7:
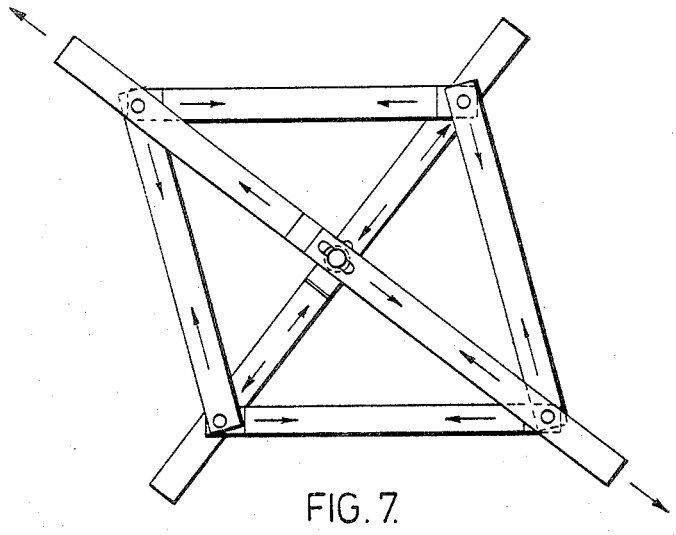
FIG. 7 is an elevation view illustrating the motion of the friction device shown in FIG. 6.

The device illustrated in the embodiment shown in detail in FIG. 6, is designed not to slip under normal service loads and moderate earthquakes, but during severe seismic exitations, the device slips at a predetermined load before yielding occurs in the other structural elements of the frame. Slippage in the device then provides a mechanism for the dissipation of energy by means of friction. As the braces **18*h* and 18*i*** carry a constant load, the remaining loads are carried by the moment resisting frame.

Figure 8:
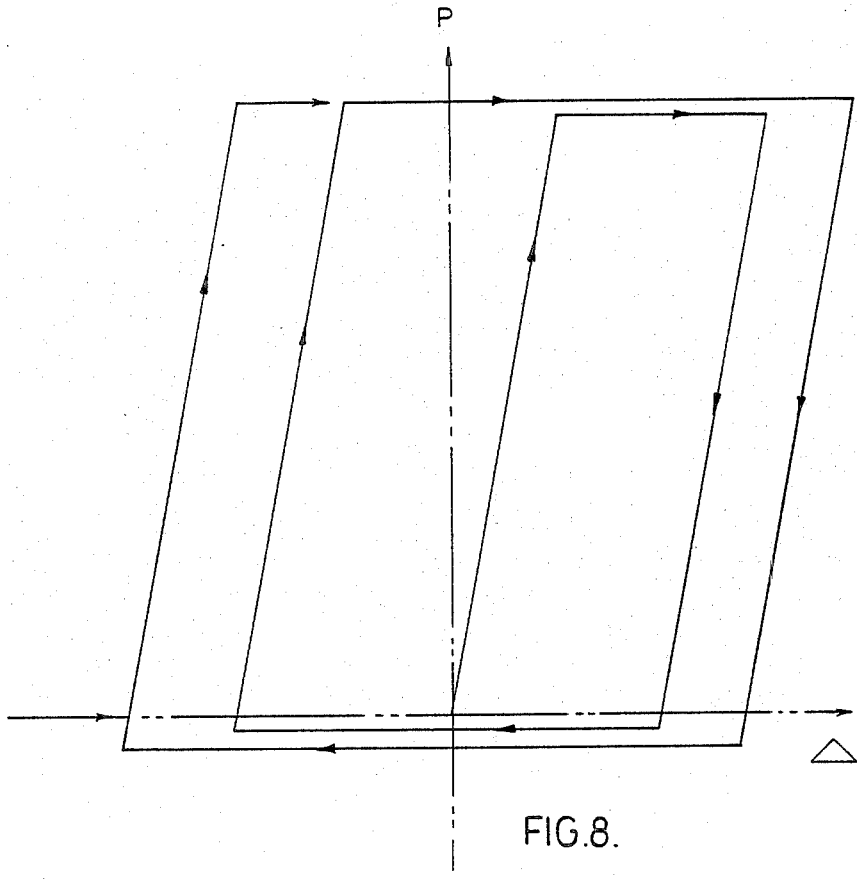
FIG. 8 is a hysteresis loop indicating the relative displacement with force of the embodiment of the invention shown in FIGS. 5, 6 and 7.

In this manner, redistribution of forces takes place between successive storeys, forcing all the braces in each moment resisting frame to slip and participate in the process of energy dissipation. Hysteresis behaviour of this device is shown in FIG. 8 and it is seen that there is no pinching of the hysteresis loop.

Figure 9:
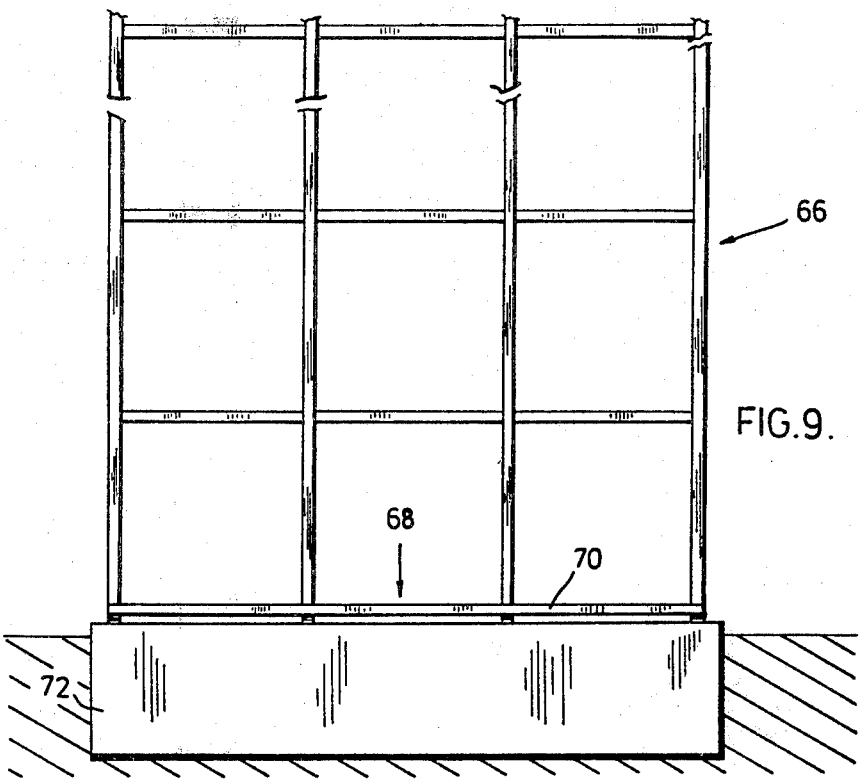
FIG. 9 is an elevation view showing the location of a further embodiment of the invention which is particularly suitable for low rise buildings.
Figure 10:
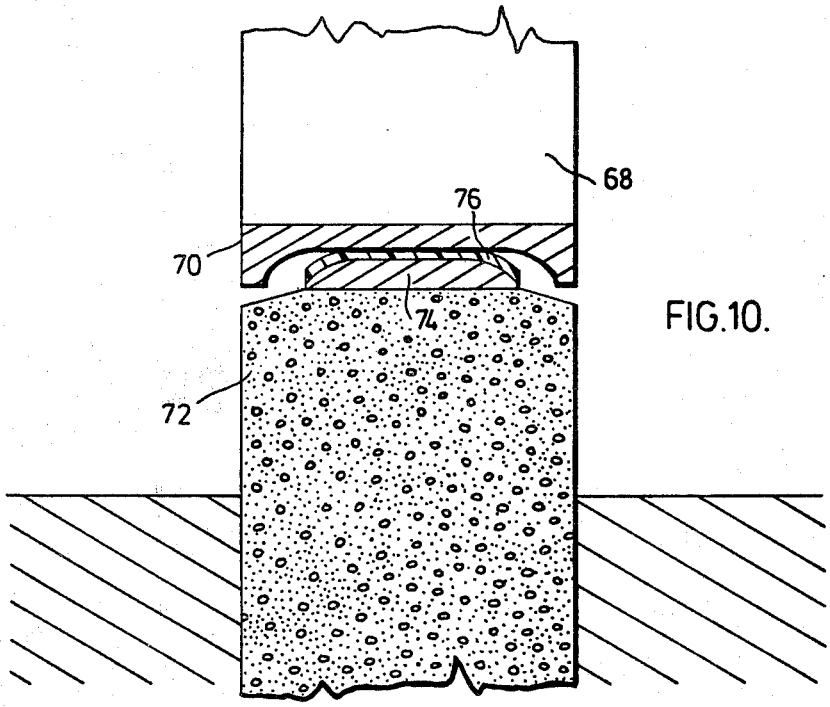
FIG. 10 is an enlarged elevational view of the embodiment illustrated in FIG. 9.

The embodiments already described are particularly effective with increasing building height, but for low rise buildings, in which over-turning moments are not predominent, a further embodiment of the invention may be used advantageously and is illustrated in FIGS. 9 and 10. The building, generally denoted by the numeral 66, in FIG. 9, which may be of solid wall construction or frame with an in-fill, has a plinth beam 68 to which is secured a plate 70 of dished configuration, as illustrated more particularly in FIG. 10. The foundation wall 72 carries a support member 74 which is located in the dished portion of the plate 70. Between the support member 74 and the dished plate 70 is a frictional surface 76 which could be conveniently formed by a brake pad.

In the embodiment illustrated in FIGS. 9 and 10 the gravity load of the structure provides the necessary clamping on the friction slip planes. Using this friction device the forces exerted on the building due to ground motion are limited to the extent of the slip load, while the dished surfaces limit the extent of the displacement.

I claim:

1. A building having first and second spaced apart structural members, a third member connecting said first and second members to form a frame, a brace extending in the plane of said frame and connected thereto, said brace having a slip joint surfaces exhibiting substantial frictional characteristics, said slip joint being constructed of opposed members secured to said frame, said slip joint including friction members in said opposed members and clamping means for forcing said opposed and friction members together to define a slippage interface for relative motion between the surfaces upon the application of a force tending to induce such motion of a large magnitude typically experienced during an earth-quake, said clamping means comprising a portion of said brace located inside said friction members and moveable to bear them against said opposed members on movement of said brace.

2. A building according to claim 1 wherein said opposed members form a cylinder tapering towards its open end and said brace positioned in said cylinder is correspondingly widened towards its end to prevent withdrawal of said brace from said cylinder.

3. A building having first and second spaced apart structural members, a third member connecting said first and second members to form a frame, a brace extending in the plane of said frame and having separate ends connected to at least two of said frame members, a further brace angularly related to said brace, said further brace also extending in the plane of said frame and having separate ends connected to at least two of said frame members, said brace and further brace having individual slip joints intermediate of their ends, each of said slip joints having surfaces exhibiting substantial frictional characteristics and including clamping means forcing said surfaces together to define a slippage interface for relative motion between the surfaces upon the application of a force tending to induce such motion of a large magnitude typically experienced during an earth-quake, said braces being connected by a pivotal member secured to said frame, whereby on slipping of the slip joint in one of said braces in tension, said pivotal member forces the other brace to slip on its slip joint in low compression.

4. A building according to claim 3 wherein said braces are in crossing relationship and connected by pivotal links intermediate of the ends of said braces, said individual slip joints being located within the area bounded by said pivotal links.

5. A building according to claim 4 wherein said clamping means is common to said individual slip joints.

6. In a building having first and second spaced apart structural members, a third member connecting said first and second members to form a frame, and a first brace extending in the plane of said frame having separate ends connected to at least two of said frame members, the improvement wherein said first brace has a slip joint with surfaces exhibiting substantial frictional characteristics and stable hysteretic behavior, said slip joint surfaces including at least one metal slipping surface and at least one brake lining pad facing said slipping surface, said slip joint further including clamping means for forcing said at least one brake lining pad against said at least one slipping surface to define a slippage interface for relative motion upon the application of a force tending to induce such motion of a large magnitude typically experienced during an earth-quake, wherein said frame has second brace angularly related to said first brace, said first and second braces having slip joints intermediate their ends and wherein said braces are in crossing relationship and connected by pivotal links intermediate of the ends of said braces, said individual slip joints being located within the area bounded by said pivotal links.

7. A building according to claim 6 wherein said clamping means is common to said individual slip joints and a spacer separates said braces.

8. In a building having first and second spaced apart structural members, a third member connecting said first and second members to form a frame, and a brace extending in the plane of said frame having separate ends connected to at least two of said frame members, the improvement wherein said brace has a slip joint with surfaces exhibiting substantial frictional characteristics and stable hysteretic behavior, said slip joint surfaces including at least one metal slipping surface and at least one brake lining pad facing said slipping surface, said slip joint further including clamping means for forcing said at least one brake lining pad against said at least one slipping surface to define a slippage interface for relative motion upon the application of a force tending to induce such motion of a large magnitude typically experienced during an earth-quake, wherein said slip joint is constructed of opposed members secured to the frame and to said clamping means, a portion of the brace being located inside said opposed members and movable with respect to said opposed members, wherein said opposed members form a cylinder tapering inwardly toward its open end portion of said brace located inside said cylinder is correspondingly widened towards its end to prevent withdrawal of said brace from said cylinder.

9. In a building having first and second spaced apart structural members, a third member connecting said first and second members to form a frame, and a first brace extending in the plane of said frame having separate ends connected to at least two of said frame members, the improvement wherein said brace has a slip joint with surfaces exhibiting substantial frictional characteristics and stable hysteretic behavior, said slip joint surfaces including at least one metal slipping surface and at least one brake lining pad facing said slipping surface, said slip joint further including clamping means for forcing said at least one brake lining pad against said at least one slipping surface to define a slippage interface for relative motion upon the application of a force tending to induce such motion of a large magnitude typically experienced during an earth-quake, wherein said frame has a second brace angularly related to said first brace, said first and second braces having slip joints intermediate their ends and wherein said braces are connected by a pivotal member secured to said frame, whereby on slipping of the slip joint in one of said braces in tension, said pivotal member forces the other brace to slip in its slip joint in low compression.

10. In a building having a foundation wall and a plinth beam mounted above said foundation wall, the improvement comprising a slip joint exhibiting substantial frictional characteristics between the foundation wall and plinth beam, said slip joint including:

a dished plate secured to the underside of the plinth beam;

a support member carried by the foundation wall, said support member engaging the dished portion of the dished plate and being adapted to move laterally within said dished portion under the ground motion created by a major earth-quake, and a brake lining pad located between said dished plate and support member.

11. In a building having a foundation wall and a plinth beam mounted above said foundation wall, the improvement comprising a slip joint exhibiting substantial frictional characteristics between the foundation wall and plinth beam, said slip joint including:

a dished plate secured to the underside of the plinth beam;

a support member carried by the foundation wall, said support member engaging the dished portion of the dished plated and being adapted to move laterally within said dished portion under the ground motion created by a major earth-quake, and a frictional contact surface provided between said dished plate and support member.

* * * * *